United States Patent [19]

Thrift et al.

[11] Patent Number: 4,894,964

[45] Date of Patent: Jan. 23, 1990

[54] BUILDING STRUCTURE AND METHOD

[75] Inventors: Richard E. Thrift, Peculiar; Harold W. Young, Kansas City, both of Mo.

[73] Assignee: U.S. Truss Steel Buildings, Inc., Peculiar, Mo.

[21] Appl. No.: 302,571

[22] Filed: Jan. 25, 1989

Related U.S. Application Data

[63] Continuation-in-part of Ser. No. 217,086, Jul. 7, 1988.

[51] Int. Cl.[4] ..... E04B 7/02

[52] U.S. Cl. ..... 52/90; 52/289; 52/199; 52/643; 52/702; 52/745

[58] Field of Search ..... 52/90, 92, 93, 262, 52/289, 198, 199, 303, 639, 643, 690, 702, 745, 746, 747, 729, 693

[56] References Cited

U.S. PATENT DOCUMENTS

| | | | |
|---|---|---|---|
| 1,336,471 | 4/1920 | McGirr . | |
| 2,027,882 | 1/1936 | Ross . | |
| 2,085,472 | 6/1937 | Roush . | |
| 2,201,504 | 5/1940 | Ruppel . | |
| 2,270,161 | 1/1942 | Briggs . | |
| 2,541,784 | 2/1951 | Shannon . | |
| 2,603,171 | 7/1952 | Smith . | |
| 2,612,854 | 10/1952 | Fuge . | |
| 2,950,786 | 8/1960 | Markle . | |
| 2,956,256 | 11/1960 | Dean . | |
| 3,172,507 | 3/1965 | Blyveis . | |
| 3,343,321 | 9/1967 | Axelsson . | |
| 3,376,676 | 4/1968 | Tatevossian | 52/93 |
| 3,474,582 | 10/1969 | Wah et al. . | |
| 3,638,380 | 2/1972 | Perri . | |
| 3,708,982 | 1/1973 | Gaspers . | |
| 3,845,592 | 11/1974 | Patena . | |
| 3,999,338 | 12/1976 | Behan, Jr. et al. . | |
| 4,011,697 | 3/1977 | Fedalfi . | |
| 4,030,256 | 6/1977 | Ollman . | |
| 4,425,742 | 1/1984 | Markey et al. . | |
| 4,551,957 | 11/1985 | Madray . | |
| 4,559,748 | 12/1985 | Ressel . | |
| 4,561,230 | 12/1985 | Rionda et al. . | |
| 4,642,958 | 2/1987 | Pewitt | 52/90 |
| 4,653,239 | 3/1987 | Randa | 52/90 |
| 4,688,358 | 8/1987 | Madray | 52/90 |
| 4,773,192 | 9/1988 | Andrews | 52/90 |
| 4,809,480 | 3/1989 | Hale | 52/702 |

FOREIGN PATENT DOCUMENTS

| | | |
|---|---|---|
| 295598 | 3/1954 | Switzerland . |
| 719711 | 12/1954 | United Kingdom . |

*Primary Examiner*—Carl D. Friedman
*Assistant Examiner*—Caroline D. Dennison
*Attorney, Agent, or Firm*—Litman, McMahon & Brown

[57] ABSTRACT

A building structure comprises first and second truss members having cross-members extending therebetween. Each truss member has a generally I-shaped cross-section, of generally constant cross-sectional dimensions, defining elongate longitudinal channels. The longitudinal channels are sized to appropriately receive and retain ends of cross-members extending between the truss members. Supports mounted in the longitudinal channels form receiving pockets which are engaged by the cross-members. A plurality of truss members, formed as parallel arches, may be utilized to form a load-bearing framing structure of a completed building, which may be enclosed by wall coverings such as panelling, siding, plywood or the like. The absence of load-bearing sidewalls permit doors, windows, deck units or the like to be easily introduced into sidewalls. The truss members, having little or no cross-bracing or bridging-work, and narrow, relatively constant cross-sectional dimensions, may be easily enclosed within inner and outer walls, along with insulation, for a secure, aesthetically pleasing, arrangement. The building may be relatively easily constructed according to a method of the present invention from readily available and easily handled materials.

5 Claims, 4 Drawing Sheets

Fig. 4.
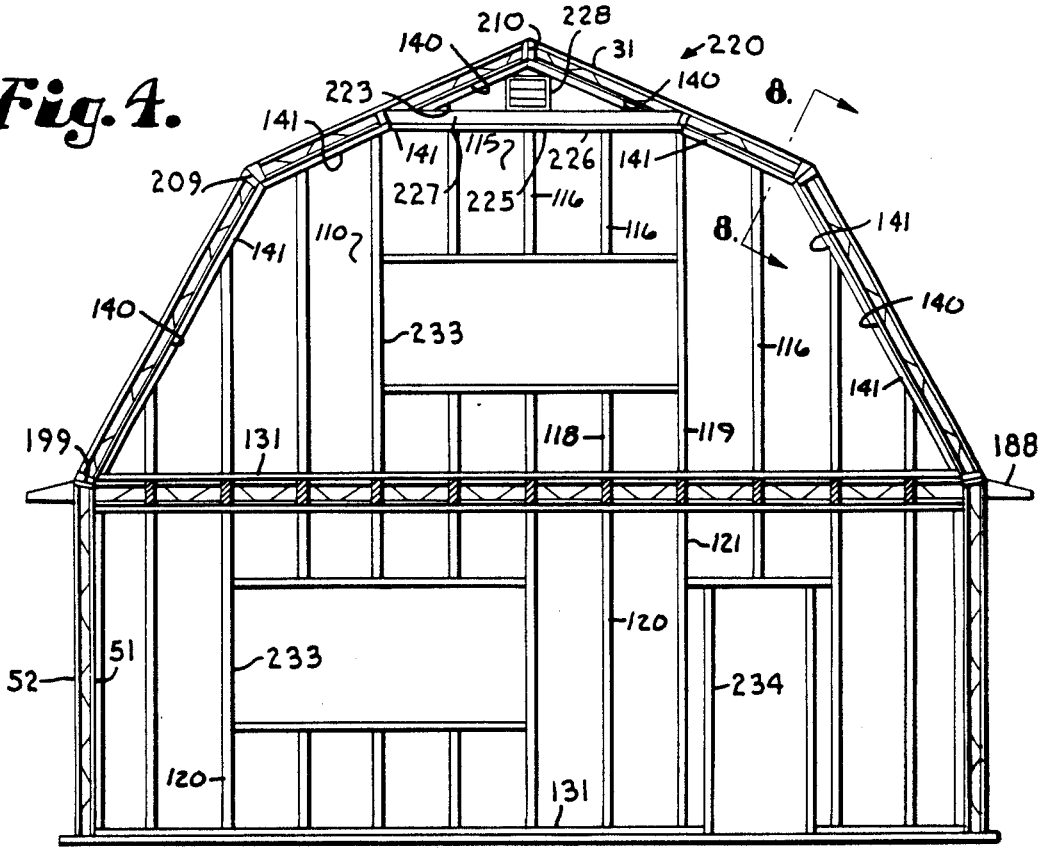
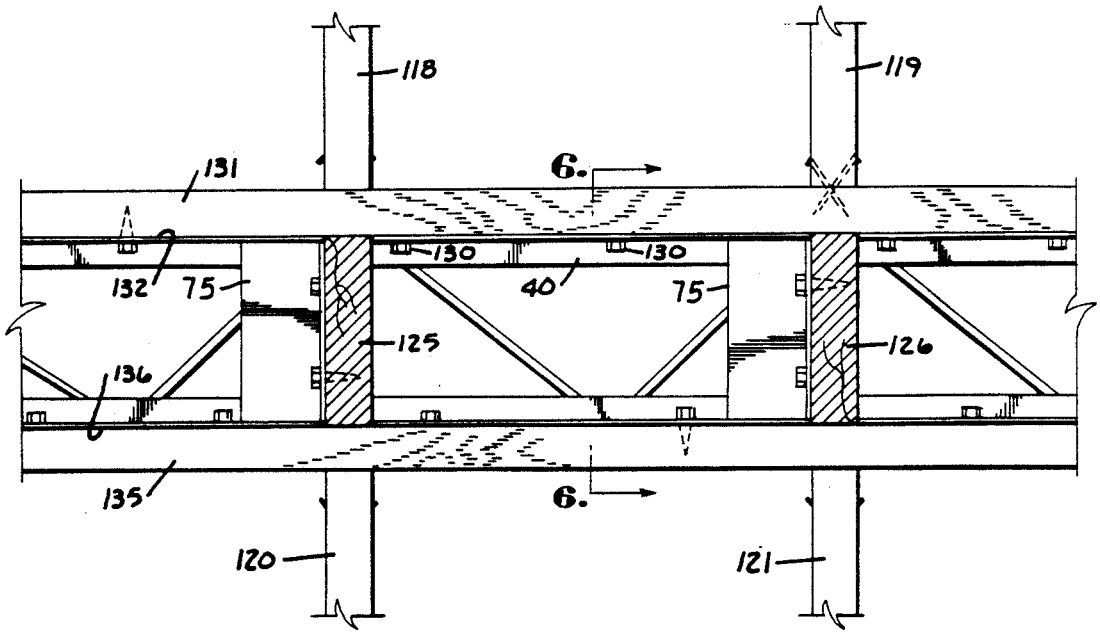
Fig. 5.

BUILDING STRUCTURE AND METHOD

CROSS-REFERENCE TO RELATED APPLICATION

This is a continuation-in-part of patent application Ser. No. 07/217,086, filed July 7, 1988 for FRAME SYSTEM FOR BUILDING STRUCTURE.

BACKGROUND OF THE INVENTION

The present invention relates to building structures and methods and in particular to a frame system for utilization in building structures wherein cross-members are extended between load-bearing truss members There has developed a substantial need for buildings which can be relatively rapidly and easily constructed. Such buildings are frequently utilized as residences in vacation and recreational areas, and as out-buildings for the storage of machinery, or the enclosure of workshops or the like.

It is often preferred that such buildings be relatively easily and rapidly constructed. One of the reasons for this is that, due to the often relatively remote locations selected for construction, they would be relatively expensive to construct if large and highly skilled crews were needed on-site for a considerable length of time. Also, the building season for some places where such buildings may be constructed as for example in ski resort areas, may be relatively short and thus favor relatively rapid construction. Or, if they are to be constructed by "do-it-yourselfers", it will be preferred that construction be capable of completion during a relatively short period of time to accommodate a vacation period or the like Although pre-fabricated buildings have, in part, been developed to solve such needs, they often suffer from numerous problems For example, if large pre-fabricated portions of buildings are constructed off-site, they must be transported to the building site, which may require large equipment, and in many instances the site may be remote and difficult to access. If the pre-fabricated units are to be constructed on-site, then many of the problems relating to the need for skilled laborers in a remote location may remain.

With respect to out-buildings, it may be preferred that the building have a high ceiling to accommodate machinery which may be stored or set up therein. Further, it may be preferred that the building not utilize interior load-bearing walls, so that a large open floor spaces will be possible. Also, large non-load-bearing exterior wall sections may be preferred in order to permit garage door-type, openings therein.

With respect to residential units, it also may be preferred that the building have exterior wall sections which are non-load-bearing, so that windows, deck units, and door units may be easily introduced almost wherever desired. Further, relatively high ceilings are often preferred for aesthetics and, in such buildings, sleeping lofts or interior deck units are often desired as they permit more efficient use of minimal lot area.

It will generally be preferred that buildings of the type previously described be capable of relatively easy and rapid construction. The ease of construction would permit the building to be erected with a minimal use of highly skilled labor at the construction site, thus contributing to low labor costs. If the building can be rapidly constructed, again cost savings will result, and also relatively short construction periods or construction seasons may be accommodated.

It will also be generally preferred that such buildings be constructed from materials, or parts, which are of relatively small size. If a large number of big construction units or parts can be avoided, then the materials can be more readily transported to the construction site, and handled thereat with a minimum of heavy equipment. This will not only facilitate transport of materials to the construction site, and ease of handling during construction, but may also permit less destruction of the landscape surrounding the construction site. That is, if very large construction pieces or units are utilized, a considerable amount of large equipment may be necessary, which often may require open, perhaps graded, areas around the construction site.

It will generally be preferred that such buildings be constructable from relatively readily available, standard-sized, units of material such as lumber, and with a minimum of specially constructed or custom-type units. In this manner, economic efficiencies will be realized and many materials readily available at or near somewhat remote locations may be used. Also the amount of power equipment which might be needed may be minimized, and the ease of construction may be facilitated.

In some instances it may be preferred that the building units or pieces, such as lumber from which the buildings are constructed, be readily engageable with one another to form the building frame, so that the frame can be readily erected and maintained with little bracing, temporary or otherwise. This would enable the building to be relatively rapidly constructed by a minimal crew, since the pieces of the building would easily fit into or engage one another in a secure manner. Also, the frame of the building will be less likely to have to withstand inclement weather, while under temporary bracing, so weather damage during construction may be reduced. Buildings such as those described can foreseeably be constructed from framing units comprising truss members which are then enclosed by wall and roof coverings. Conventional truss members, however, often utilize extensive bridge-work or cross-bracing elements which connect elongate truss extensions, for bracing and strength. While in certain types of buildings such cross-bracing may be acceptable, in residential units it may be unsightly, and may interfere with the ability to fully enclose and insulate the walls and roof. In out-buildings, such cross-braces may interfere with the open area preferred for the storage or assembly of machinery or equipment.

OBJECTS OF THE INVENTION

Therefore, the objects of the present invention are: to provide a building structure and method which utilize load bearing truss members extending transversely of the building and having cross-members mounted thereon and extending generally perpendicularly thereto, for supporting wall sections; to provide such a building structure and method with a framing system including a pair of arch units each having relatively constant cross-sectional dimensions throughout with cross-members extending therebetween; to provide such an arch unit in which each truss member includes a longitudinal channel therein, the channels having support members mounted thereon to form cross-member receiving pockets, cross-members being extendable between the truss members by insertion into the cross-member receiving pockets; to provide a framing system which permits a pair of such arch units to be constructed adjacent one another through the utilization of three truss members comprising two side members and a central member with cross-members extending between each side truss member and the central truss member; to provide such a framing system in which the truss members have a generally I-shaped cross-section providing two longitudinal channels in which cross-members may be received; to provide such a framing system in which receiving pockets formed in the truss units are appropriately sized, relative to cross-members, to snugly receive same and retain same within a selected position by frictional engagement, facilitating construction; to provide such a framing system which is of relatively narrow width so that it may be completely enclosed by inner and outer coverings to enclose a wall, roof or floor; to provide such a framing system from which a building having no load-bearing interior walls can be constructed; to provide such a framing system from which a building may be constructed in which a substantial portion of the building wall and roof load may be supported by relatively small truss units, so that large portions of the wall or roof of the building may be utilized as windows, doorways, skylights or the like; to provide a framing system for a building comprising a plurality of arch units, constructed from truss members, which arch over and across a foundation and between which cross-members extend, with wall and roof members or coverings being mountable on the cross-members; to provide a framing system characterized in part by the absence of extensive bridging-work or bracework extending vertically or diagonally between major truss members thereof; to provide a framing system for a building in which a second floor or loft may be relatively easily provided; to provide a framing system for a building which is relatively easy to construct and which may be constructed relatively rapidly; to provide such a framing system which may be constructed from materials relatively easy to transport and assemble; to provide such a framing system with parts or components which are relatively easy and inexpensive to manufacture; and to provide such a framing system which is particularly well adapted for the proposed usages thereof.

Other objects and advantages of this invention will become apparent from the following description taken in connection with the accompanying drawings wherein are set forth, by way of illustration and example, certain embodiments of this invention.

SUMMARY OF THE INVENTION

A building structure and method is provided which includes a type of framing unit from which a building frame can be relatively readily and inexpensively assembled. The framing unit comprises first and second generally parallel, and laterally spaced, truss members having a cross-member or a series of cross-members extending therebetween. Wall or roof portions may be mounted on the cross-member(s) to enclose the framing unit.

Each truss member includes an elongate central portion having a cross-section of generally constant cross-sectional dimensions throughout. Thus, there are no substantial bulges in the truss member, nor is there any extensive bridge-work or bracing-work creating extensions from the truss members. As will be seen from the drawings, this permits the truss members to be relatively narrow in width or thickness and, therefore, to be relatively easily enclosed within wall coverings, which is generally aesthetically preferable and enables generally easier and more effective wall covering and insulation.

Each truss member of a framing unit includes an elongate longitudinal channel extending therethrough. Preferably, the channel is defined by two elongate parallel sides or side flanges, between which a portion of a cross-member may be received. Mounted in each active longitudinal channel is at least one cross-member support, which forms a pocket with the channel walls. It is into the pocket that the portion of cross-member is received during building construction. Generally, the truss members of any framing unit are oriented so that the respective cross-member receiving pockets generally face one another, for a cross-member to be extended therebetween.

In the preferred embodiment, the cross-members comprise timbers or extensions of lumber pre-cut to preferred, and standard, dimensions For wall and roof cross-members, generally two-inch by six-inch (nominal cross-sectional dimensions) pieces of lumber cut to appropriate lengths are preferred. When the framing unit is used to support a floor, generally two-inch by ten-inch members are preferred.

Preferably the truss members are composed of a relatively rigid, noncompressible or non-deformable, material such as steel. Under these conditions, if the cross-member receiving pocket is sized to relatively snugly receive one of the ends of the cross-member, the wood of the cross-member will compress slightly as it is pounded into the pocket and will be retained in position by frictional forces. However, if desired, screws, bolts or the like may be utilized to secure the connection of the cross-member(s) with the truss member(s).

A building method utilizing such framing units generally involves the erection of the truss members, with cross-member receiving pockets facing toward one another. Cross-members may then be relatively quickly pounded or hammered into position by extension between associated receiving pockets. If the framing unit is utilized for a wall, then wall coverings such as plywood, siding, plasterboard, or other panel-type coverings may be suspended from the cross-members. If desired, insulation may be easily placed between cross-members and retained within the wall, underneath the wall coverings.

In the preferred embodiment, each truss member has a generally I-shaped cross-section defining two opposite longitudinal channels, each of which has two parallel sidewalls or side flanges. The width of the channel, again, is appropriate for snugly receiving the desired size of cross-member(s). From such I-beam shaped truss members, a plurality of adjacent framing units may be constructed. That is, cross-member receiving pockets may be formed on opposite sides of a given truss, for receipt of cross-members from different directions. Thus, two adjacent framing units may be constructed from three truss members, two truss members forming side or end truss members and one forming a central truss member.

As will be understood from the drawings and the detailed description, an entire building may be constructed from such framing units. Preferably, for such a building, the truss members are formed into arches which extend transversely over the building foundation. The arch units will preferably extend generally parallel to one another, with cross-members extending therebetween.

In the preferred embodiment, described and shown, lower portions of the arch units extend somewhat vertically, to form the sidewalls of the building. Upper, obtusely extending, units form a roof of the building, preferably with a knee or bend therein.

Such a building as previously described may be constructed according to the method of the present invention with the absence of any internal, load-bearing walls. That is, there are no internal walls which support the weight of the building, and in particular the weight of the roof. Further, in the absence of substantial bridgework, a large amount of open space within the building is available, and, the truss units may be relatively easily and substantially covered by the wall coverings, facilitating construction, insulation and aesthetics.

Such a building as that described will be understood to have first and second end portions, and sidewalls. The end portions may be enclosed in a relatively traditional manner by toenailing vertical studs into an end-wall frame. The sidewalls, however, generally comprise wall coverings mounted on the horizontal cross-members that extend between the truss members. These sidewalls may be interrupted at nearly any location by a door, window or the like, as desired, since the building frame weight, and the weight of the roof, are basically taken up and supported by the arch units of truss members themselves. Thus, the building is readily utilizable when large garage doors in the sidewalls may be desired, or for a building that is to be used as a recreational home in which large viewing windows or sliding doors may be desired.

In the preferred embodiment, each arch unit includes a horizontal truss member extending thereacross. This truss member helps the truss frame retain its integrity against the weight of the roof. Further, the horizontal truss member may be utilized to support floor joists and thus a second level or loft within the building.

Preferably, the horizontal truss members of adjacent arch units each include an elongate longitudinal channel therein, with support members mounted to form cross-member receiving pockets, so that cross-members or floor joists may be extended between the adjacent horizontal beams to form the frame of the second floor or loft. In the preferred embodiment, the horizontal beam members have an I-shaped cross-section similar to the truss members along the vertical walls and the roof.

The preferred truss member, of I-shaped cross-section, includes a plurality of angle clips or supports mounted therein, as by welding, to which cross-members may be attached Although the cross-members will be generally held in place by frictional pinching into the pocket(s) formed by the supports or clips with the walls of the longitudinal channel(s), screws or bolts may be used to further secure the cross-members to the angles or clips.

The preferred truss members also include holes or apertures drilled in the outer walls or flanges thereof. These may be utilized for the attachment of wood pieces such as header boards, base boards, or the like, to which portions of the frame or portions of wall coverings may be nailed. When a wood backing or nailer is needed along a side of the I-beam or I-truss in which a longitudinal channel is located, the channel may be filled by an extension of lumber to form the nailer.

The drawings constitute a part of this specification and include exemplary embodiments of the present invention and illustrate various objects and features thereof. In some instances material thickness may be shown exaggerated or reduced relative to other portions of the building, for clarity.

BRIEF DESCRIPTION OF THE DRAWINGS

FIG. 4 comprises an enlarged, side, cross-sectional view of a partially constructed building according to the present invention, taken generally from the view of line 4—4 in FIG. 2.

FIG. 5 comprises an enlarged, fragmentary, view of a portion of FIG. 4.

DETAILED DESCRIPTION OF THE PREFERRED EMBODIMENT

Figure 1:
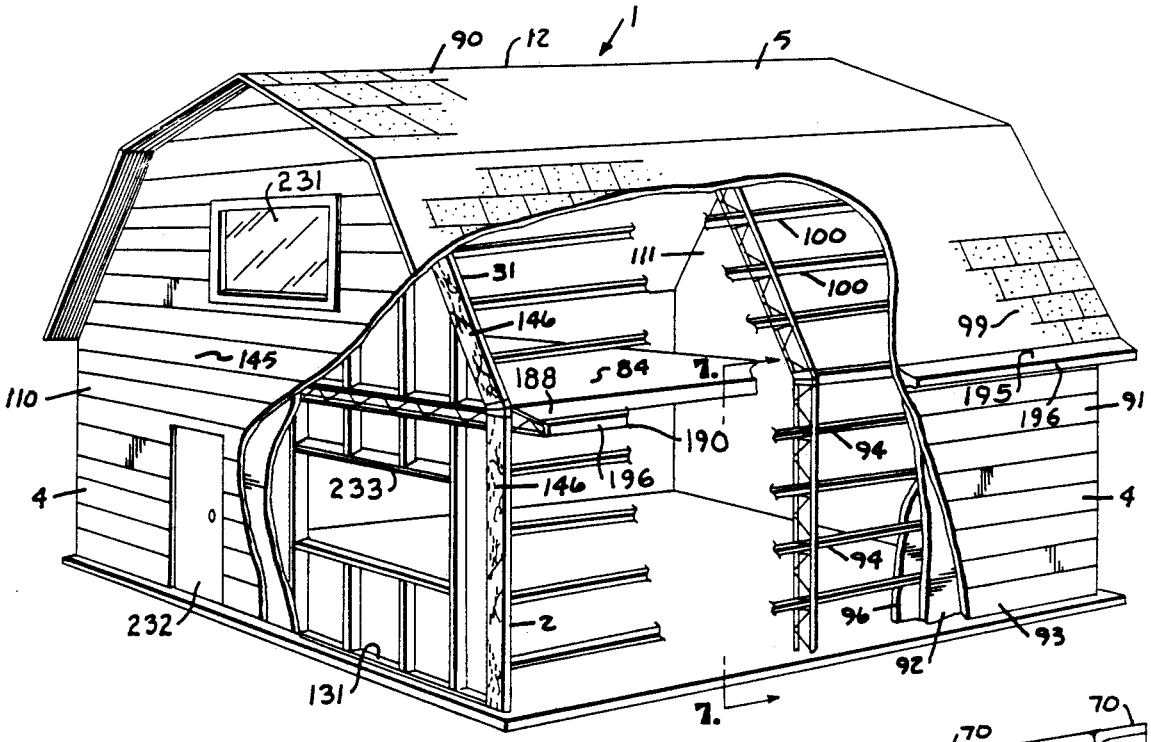
FIG. 1 is a perspective view of a building according to the present invention, with portions broken away to show internal detail.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but rather merely as a basis for the claims and as a representative basis for teaching one skilled in the art to variously employ the present invention in virtually any appropriately detailed structure.

Referring to the drawings in more detail:

The reference numeral 1, FIG. 1 generally designates a building or building structure constructed according to the present invention with a framing system 2. In FIG. 1, the building 1 is shown with its framing system or building frame 2 generally completely assembled and covered by outer walls 4 and a roof 5.

Figure 2:
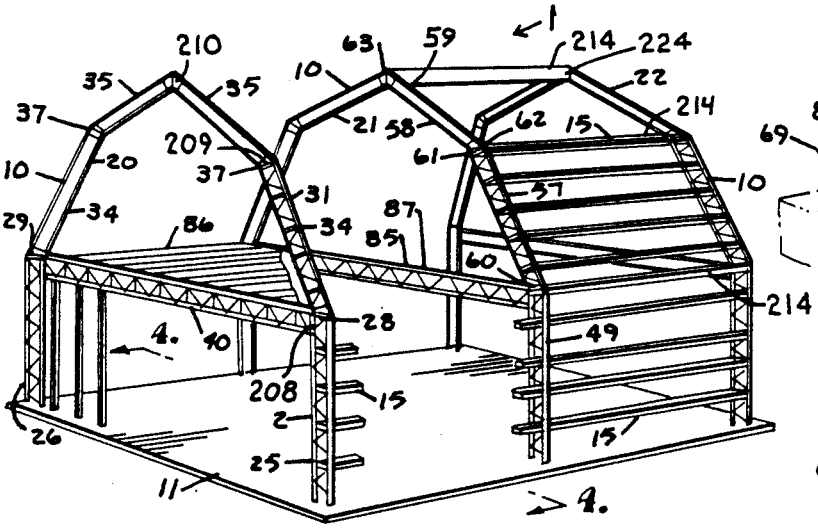
FIG. 2 is a reduced perspective view of a building according to the present invention, shown partially constructed and with portions broken away to show internal detail.

In FIG. 2 the building 1 is shown during a stage of partial completion. The framing system 2 is observable without the wall coverings, for clarity. Generally, by FIG. 2, it will be understood the building frame 2 comprises, in part, a plurality of arches or arch units 10 extending over, and transversely of, a rectangular foundation (e.g. a concrete slab) 11. From FIG. 2 it will be understood that a plurality of cross-members 15 extend between the arch units 10 of adjacent arches. The utilization of such cross-members 15, as will be understood from further description, affords many of the advantages of the present invention.

Referring to FIG. 2, in the preferred embodiment shown the framing system 2 includes three arch units 10, comprising a front arch unit 20, a central arch unit 21 and a rear arch unit 22. The three arch units 20, 21 and 22 respectively, are substantially similar to one another except as is necessary to accommodate their varying positions in the building 1. These differences will be understood from the following descriptions and reference to the drawings. However, initially description will focus upon the ways in which the arch units 20, 21 and 22 are similar.

Referring to the front arch unit 20, FIG. 2, an arch unit in the preferred embodiment includes first and second end units, or vertical truss members, 25 and 26 which extend upwardly from the foundation 11. The vertical truss members 25 and 26 are preferably substantially identical to one another in length and cross-section. They may be anchored to the foundation 11 by means of bolts or the like.

Each vertical truss member 25 and 26 has an upper end 28 and 29 respectively. Arching between the upper ends 28 and 29, through a vertical arch, is an upper arching portion 31 of the arch unit 20. The upper arching portion 31 is formed from two pair of obtusely extending arch members, a first pair of lower arch truss members 34 and a second pair of upper arch truss members 35 which extend upwardly, at angle, to join and complete the arch 31. By reference to FIG. 2, it will be understood that the vertical truss members 25 and 26 and the arch truss members 34 and 35, cooperate to form a single front arch unit 20 extending over and transversely of the foundation 11.

In order to add structural integrity to the arch unit 20, and prevent spreading of the truss members 25, 26, 34 and 35 which form the arch unit 20, the arch unit 20 includes a horizontal beam or truss member 40 extending horizontally between the vertical truss member upper ends 28 and 29.

By reference to FIGS. 1 and 2, it will be understood that arch units 21 and 22 are generally similar to arch unit 20, at least in so far as the previous description is concerned. Generally, arch units 20, 21 and 22 are aligned parallel to one another so that they will securely support the walls 4 and roof 5 over the foundation surface 11 of the building 1.

In the preferred embodiment the truss members 34 and 35, of the upper arching portion 31 are substantially identical to the vertical truss members 25 and 26, except that ends of the truss members 34 and 35 may be beveled differently to provide for the arch. For a given arch unit 10, the individual vertical and arching truss members 25, 26, 34 and 35 are preferably securely attached to one another in series, as by bolting or welding, to completely form the arch. The horizontal beam 40 may be suspended within the arch unit 20 as by bolting, welding or the like.

Figure 3:
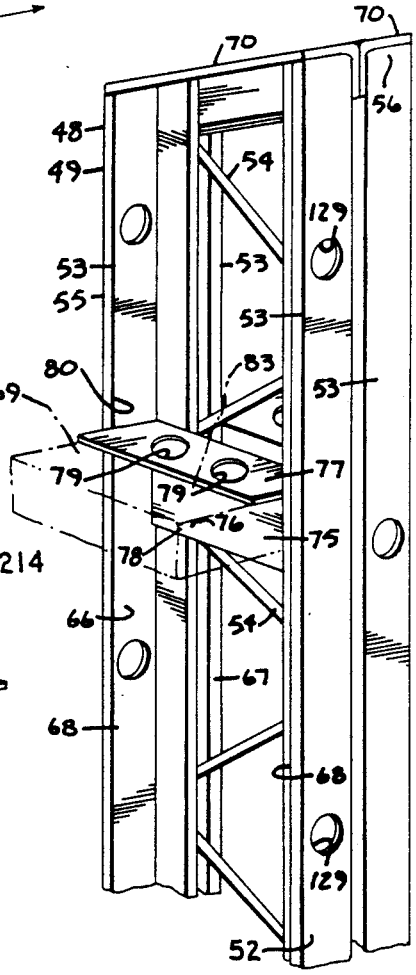
FIG. 3 comprises an enlarged, fragmentary, perspective view of a truss member used in a building according to the present invention, with phantom lines indicating a cross-member, or piece of lumber, engaged by the truss member.

The general structure of the truss members of the arch units 10 will be understood by reference to FIG. 3. In FIG. 3, the truss member 48 depicted is one of the vertical truss members 49 of the central arch 21, however the general structural features apply to all truss members in the building 1. Truss member 48 has a generally I-shaped cross-section defined by four elongate angles or angle sections 53 welded or otherwise secured together into the orientation shown in FIG. 3, with a central chord or cross-bracing 54 extending therebetween. Inner and outer pairs of angle sections 53 form inner and outer faces 51, 52 respectively of the truss member 48. Thus, the truss member 48 has a central portion 55 having an I-shaped cross-section, of constant cross-sectional dimensions, extending generally throughout its entire length, except for beveled end 56 which is used to orient the upper arching portion 21.

Referring to FIG. 2, the truss members 57 and 58 of the upper arch portion 59 are generally similar, except for their beveled ends 60, 61, 62 and 63. However, these latter truss members also preferably have a generally I-shaped cross-section of constant cross-sectional dimensions extending between their beveled portions. By "constant cross-sectional dimensions" it is meant that the width and thickness of the I-beams or I-shaped trusses are generally constant throughout their extension. As will be understood from the below description, this enables truss members, and a truss member frame, without bulges therein, and without extensive cross-bracing or bridge-work. That is, each truss member is similar to an elongate beam of narrow and constant cross-section which may be relatively easily enclosed within a relatively narrow wall, without having portions extending therefrom.

Referring again to FIG. 3, the I-shaped cross-section of the truss member 48 defines first and second elongate longitudinal channels 66 and 67, oriented on opposite sides of the truss member 48 with respect to one another. The elongate channel 66 is defined between sidewalls or flanges 68 of the angle sections 53 and extends substantially continuously along the entire length of the truss member 48. Elongate channel 67 is analogous and extends along an opposite side of the truss member 48. Referring to FIGS. 1, 2 and 3, the elongate channel of any truss member, for example vertical truss member 49, is sufficiently wide to receive a compressed portion of a cross-member 15 therein. In FIG. 3 a portion of cross-member 69, in phantom lines, is shown received within the longitudinal channel 66. Also referring again to FIG. 3, the upper end 56 of the truss 49 is shown enclosed by angle sections forming an endpiece 70 welded thereto. However, a variety of means of enclosing an end of the truss member 49 may be used.

In the preferred embodiment, the longitudinal channels of each truss member, into which a cross-member is to be received, include a plurality of cross-member supports or clips 75 mounted therein. Referring to truss member 48, FIG. 3, a support or clip 75 is shown mounted in the longitudinal channel 66 as by welding. The support 75 generally comprises an angle-shaped piece 76 of material such as steel, having first and second flanges 77 and 78 respectively. The first flange 77 includes apertures or receivers 79 therein. It will be understood that the cross-member 69 may be attached to the flange 77 by means of bolts or screws extending through the apertures 79.

Referring further to FIG. 3, the support 75 and longitudinal sidewalls 68 cooperate to form a cross-member receiving pocket 80. This pocket 80 is preferably sized to snugly receive an end 83 of a cross-member 69 therein. It will be understood that if the cross-member 69 is constructed from wood and the truss member 48 is constructed from steel, then the cross-member 69 will be compressible relative to the truss member 48 and may be snugly received within the pocket 80 and retained therein. For a particularly tight fit, a hammer or mallet may be used to drive the cross-member 69 into the receiving pocket 80. The advantage to such a snug fit is that bracing structure or excessive bracing may be avoided while the framing system 2 is being assembled. Rather, each cross-member 15 may be easily and quickly mounted between adjacent arch units 10.

By reference to FIGS. 1 and 3, it will be understood that a truss member such as truss member 49 of the central arch unit 21, may include longitudinal channels and cross-member receiving pockets 80, formed from supports such as support 75, positioned on opposite sides thereof, so that cross-members 15 may extend in opposite direction from the central arch member 21 toward each of the side arch units 20 and 22. The side units 20 and 22, however, only require receiving pockets on one side thereof, since cross-members 15 only encounter them form one direction. It will be understood that a building utilizing truss member according to the present invention may be constructed utilizing only two arch units or with virtually any plurality of arch units, with the respective end or side units only requiring cross-member receiving pockets on one side, i.e. the inside, thereof, and with generally all centrally located truss members or arch units having receiving pockets on both sides thereof, for engaging and supporting cross-members on both sides.

Generally, the cross-member receiving pockets, analogous to pocket 80, FIG. 3, are positioned appropriately in the arch units 10, and corresponding truss members, so that the cross-members 15 extend generally horizontally. In this manner, the cross-members 15 extend generally perpendicularly to any truss members between which they are suspended. As a result, for each support 75 or receiving pocket 80 mounted in a truss member, there will generally be a corresponding support or receiving pocket in an appropriately aligned adjacent truss member.

Referring again to FIGS. 1 and 2, the horizontal truss members which form horizontal beams in arches 21 and 22, analogously to beam 40 in arch unit 20, may be used to form a loft or second floor 84 in the building 1. The horizontal beams or truss members 40 may be attached to the vertical truss members 25, 26 by providing a pair of respective angle sections or pieces 73 attached (e.g. by welding) to the vertical truss angle sections 53 which are located on the inner sides of the vertical truss members 25, 26 in proximity to their upper ends 28, 29. Corresponding angle pieces 74 can be mounted on the opposite ends of the horizontal truss members 40 to form endpieces 70 for bolting to respective vertical truss angle pieces 73. Generally, the support frame 85 of the loft 84 is formed from a plurality of floor joists 86 extending between horizontal beams in adjacent arch units, such as beams 40 and 87 in arch units 20 and 21 respectively. The floor joists 86 may be received within channels in the beams 40 and 87 analogously to cross-members 15 in the wall or roof portions. That is, generally the horizontal truss members or beams 40 and 87 include analogous longitudinal channels, supports, and cross-member receiving pockets The floor joists or cross-members 86 can then be pounded into place and, if desired, retained therein by screws, to support the loft 84.

It will be understood that a variety of types of cross-members 15 and 86 may be utilized in conjunction with the present invention; however, generally, wall and roof cross-members 15 will preferably be formed from pre-cut lumber such as standard two-inch by six-inch (nominal dimensions) boards, and floor joists 86 will be formed from two-inch by ten-inch (nominal dimensions) pieces of lumber, all cut to appropriate lengths. Preferably the arch units of a building 1 will be spaced appropriately to take advantage of standard lumber lengths, in order to avoid extra labor and material waste.

Referring to FIG. 1, the structural frame previously described can be readily covered by a roofing portion 90 and an outer wall portion 91 in order to enclose a portion of the framing system 2. The outer wall covering 91 may be, for example, plywood pieces 92, with siding 93 thereon, which are attached to the cross-members 94 that extend along the sides 95 of the building 1. The method of mounting the outer wall coverings may be by nails, or the like, driven into the cross-members 94.

Similarly, inner sidewalls 96, formed from sheets or panels of plywood, panelling, plasterboard or the like, may be readily mounted It will be understood that such wall coverings, both inner and outer, may completely cover and enclose the vertical truss members such as truss member 49, within the sidewalls of the building 1, to form relatively thin walls of uniform thickness. In part, this is facilitated by the rather narrow and constant cross-section of the truss members, such as truss member 49, which permit straight, fairly conventional looking, walls.

Similarly, the roof 5 may be enclosed as by mounting plywood sheathing 98 or the like, later covered with shingles 99 or other conventional coverings, to cross-members 100 in a roof portion 90 of the building 1. Inside of the building 1, the trusses in the roof 5, and the cross-members 100, may be similarly covered. Again, the absence of extensive bridge-work or cross-bracing, and the utilization of truss members having a relatively constant and narrow cross-section throughout, enable substantially complete enclosure of the arching truss members 31 to seal a roof portion 90 of the building and provide for an attractive appearance. As with the sidewalls, the roofing portions, both inside and outside, may be mounted by nailing or the like.

It will be understood that a ceiling portion underneath the loft or second floor 84 and a floor portion of the loft 84 may be similarly covered by plywood or the like.

If desired, wiring, plumbing, insulation and similar materials may be easily contained between the inside and outside coverings whether wall, roof or loft coverings. A particular advantage to the present invention is that the truss members may be completely enclosed within an easily and thoroughly insulated roof and wall structure.

It will be understood, from the previous description, that the sidewalls 91 and roof 90 of the building 1 may be relatively easily enclosed when the building 1 includes a structural frame 2 according to the present invention. The ends or endwalls of the building may also be easily enclosed. Referring to FIG. 1, the building 1 includes a first endwall 110 and a second, opposite, endwall 111. The endwalls 110 and 111 will be understood to be similarly constructed, although they may vary by the presence or absence of doors, windows, deck units or the like. The general construction of an endwall, for example endwall 110, will be readily understood by reference to FIGS. 4 and 5.

Referring to FIG. 4, wall 110 comprises wall coverings 115 mounted upon vertical studs such as two-by-fours 116. FIG. 5 comprises an enlarged portion of FIG. 4 focusing on vertical studs 118, 119, 120 and 121. Also, two of the floor joists 125 and 126 are shown. To enable the vertical studs 116 to be mounted, horizontal beam member 40 is provided with apertures therealong, analogous to apertures 129 in FIG. 3, through which lag screws 130 may extend. A base-board or bottom plate 131 is mounted along an upper edge 132 of the truss member 40 by means of the screws 130. Vertical studs above the loft 84 may be mounted, as for example are studs 118 and 119, by toenailing to the baseboard 131. Similarly vertical studs 120 and 121 are toenailed to a header board or top plate 135 mounted on a lower edge 136 of the truss member 40. Referring to FIG. 4 lower edges or inner faces 140 of the truss members 34 and 35 which form arching unit 31 are similarly lined with header boards or arch plates 141 to facilitate mounting of the vertical studs 116, above the loft 84.

Endwall 110 may be enclosed by a fairly conventional type of wall frame comprising wallboard mounted upon the vertically extending studs. If desired, insulation may be placed between the layers of wallboard enclosing the studs. It will be understood that windows 231 and doors 232, FIG. 4, may be introduced in openings 233 and 234 where desired by conventional framing techniques.

Referring to FIG. 1, the wall covering 145 of endwall 110 is again, generally mounted on the building by nailing to the vertical studs 116. However, it will be generally understood that it would be desirable to also have the edges of the wall covering 145, which overlap the arch unit 20 securely attached. It is noted that the portion of arch unit 20 which faces and overlaps the endwall 110, however, includes the longitudinal channels, so no headerboard analogous to headerboard 141 can be easily attached for use as a nailing surface. To accommodate this problem elongate lumber pieces 146 are inserted lengthwise into the longitudinal channels. These lumber pieces 146 provide a surface to which the wall covering 145 can be easily attached.

Figure 6:
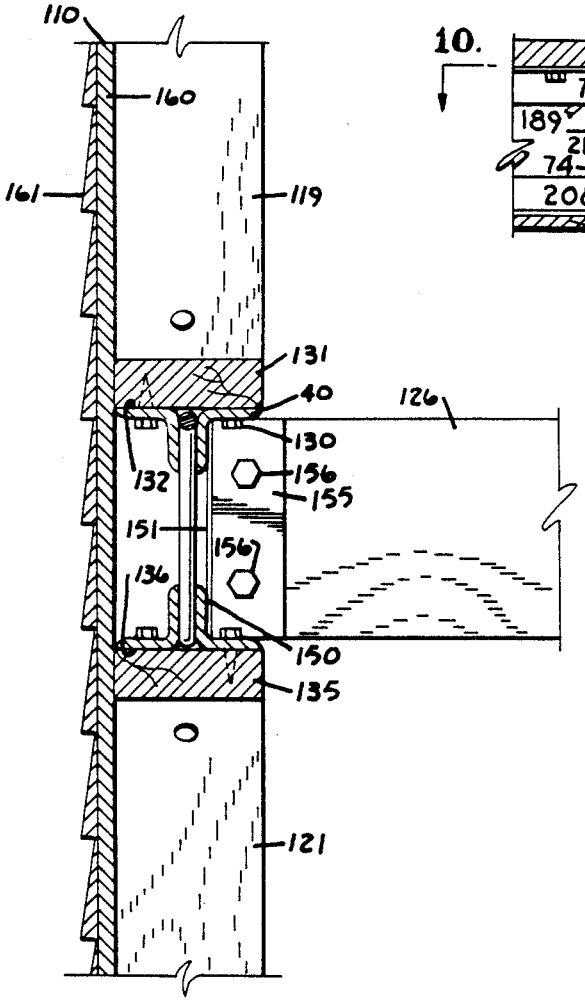
FIG. 6 comprises an enlarged, fragmentary, side cross-sectional view taken generally along line 6—6 of FIG. 5.

FIG. 6 further clarifies the building structure along the front wall 110. FIG. 6 generally comprises a fragmentary cross-section taken along line 6—6 of FIG. 5 and illustrates a floor joist 126 being received within a receiving pocket 150 within the horizontal I-beam 40. The baseboard 131 is again shown attached to the upper edge 132 of the beam 40 by means of screws 130. The headerboard 135 is shown similarly attached to a lower edge 136 of the horizontal beam 40. Studs 119 and 121 are then shown extending vertically from their points of connection to the boards 131 and 135 respectively.

In FIG. 6, floor joist 126 is shown with an end 151 inserted within the receiving pocket 150 and engaging the support or angle clip 155. The joist 126 is shown attached to the support 155 by means of screws 156, however generally the joist 126 can be expected to be retained in position by a sufficiently tight fit with the pocket 150. The outer wall 110 is shown enclosed by means of plywood sheets 160 or the like, attached to an outer portion of the building. These may, if desired, may be covered by siding 161 or similar materials. In FIG. 6 no interior wall-, ceiling-, or floor- coverings are shown, however it will be understood that any of a variety of conventional coverings for such purposes may be utilized.

Figure 7:
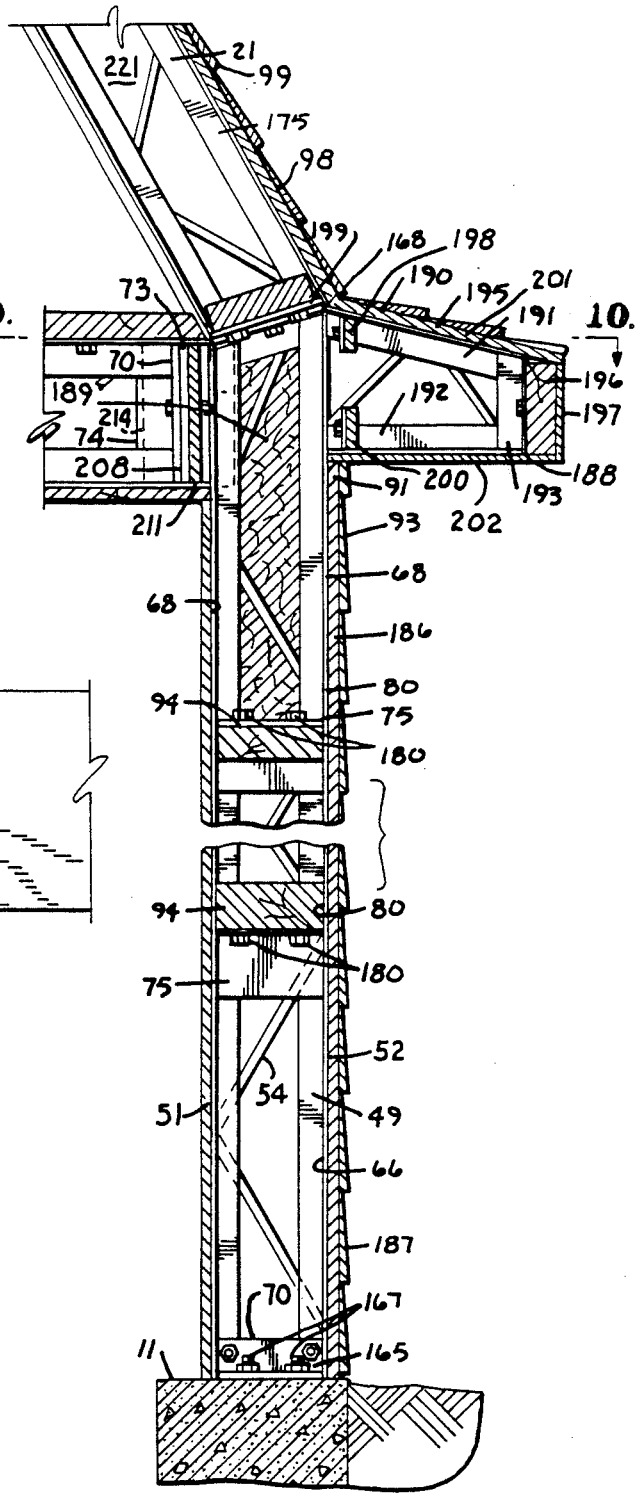
FIG. 7 comprises an enlarged, fragmentary, side cross-sectional view of a portion of a building taken generally along line 7—7 of FIG. 1.

FIG. 7 further clarifies the structuring of sidewalls 91 of the building 1, by means of a cross-sectional view taken generally along line 7—7 of FIG. 1 In FIG. 7, vertical truss member 49 is shown extending upwardly from the foundation or floor 11. The truss member 49 includes a lower end 165 having an angle plate or endpiece 70 mounted therein, as by bolting or welding Apertures, (not shown), in the endpiece 70 permit the truss member 49 to be anchored to the foundation 11 as by means of anchor bolts 167. Vertical truss member 49 will be understood to extend generally vertically from the foundation 11 until it terminates along an upper end 168.

Also in FIG. 7, one of the arching portion truss members 175 is shown mounted on the upper end 168 of the vertical truss 49 in an orientation extending generally diagonally over the foundation 11 to begin the arch of arch unit 21.

In FIG. 7 several of the cross-member supports 75 may be readily viewed. Also, portions of cross-members 94 are viewed anchored to the support 75 by screws 180. It will be understood that the ends of the cross-members 94 which are received within the longitudinal channel 66 are snugly received within cross-member receiving pockets 80 formed therein by the supports 75 and the sidewalls 68. The side wall cross-members 94 may comprise framing grade lumber with nominal cross-sectional dimensions of two inches thick by six inches wide. Such boards are commonly referred to as "two-by-sixes". The actual cross-sectional dimensions of such lumber are generally about one and five-eighths inches thick and five and five-eighths inches wide. The widths of the channels 66, 67, as defined by the horizontal spacing between the vertical truss angle side walls 68, is preferably slightly less than the actual widths of the side wall cross-members 94, i.e. about five and one-half inches. Thus, at their ends the side wall cross-members 94 are preferably compressed about one-eighth inch or so when they are forced-fitted into the respective pockets 80

The truss channels 66, 67 thus cooperate with the cross-members 94 to form a compression connection therebetween, which compression yields yet another benefit when the screws 180 are placed. Because the screws 180 are relatively close to the ends of the cross-members 15, they may tend to split the cross-member ends. According to the building method of the present invention, pilot holes may not be required for placing the screws 180, whereby splitting the cross-member ends is even more likely. However, the ends of the side wall cross members 94 are tightly clamped together within the channels 66, 67 by the side wall 68, whereby the screws 180 cooperate with the ends of the side wall cross-members 94 to from relatively tight connections between the cross-members 94 and the vertical trusses 25, 26, in spite of any such splitting. Placement of the screws 180 into the compressed ends of the cross-members 94 can achieve a desired, cooperative effect whereby shafts of the screws 180 and the split ends of the cross-members 94 are all quite tightly wedged within respective channels 66, 67. Similar, cooperative clamping and wedging effects can be likewise achieved in the other truss, cross-member connections present in the framing system 2.

In FIG. 7 the outer plywood sidewall 91 is viewable mounted along the outside of the building 1. The outer sidewall 91 generally comprises plywood sections 186 having siding 187 thereon. The plywood 186 may be attached to the cross-members 94 as by nails or the like. Also in FIG. 7, insulation 189 is viewable between the interior and exterior walls.

In FIGS. 1 and 7, an eave assembly 190 is shown mounted upon the building 1. The eave 190 comprises an eave truss member 188 with upper and lower pairs of eave angle sections or frame members 191, 192 interconnected by an eave endpiece or outer frame member 193. The eave truss member 188 is appropriately mounted upon, as by welding or bolting, the truss member 49. The eave frame members 191, 192 mount clips 194 for attaching eave roof and eave soffit nailers 198, 200, which may comprise two-by-fours, and which extend between the eave nailer mounting clips 194 of adjacent arches 10. It is envisioned that an elongate piece of lumber, such as a two-inch by six-inch piece of wood comprising a facia nailer 196, may be mounted upon an outer edge of the eave 190, to support facia 197. Eave roof sheathing 201 and eave soffit panels 202, e.g. plywood or particle board, may be applied to the eaves 190 by nailing to the eave nailers 198, 200 and by nailing to the facia nailer 196. Conventional roofing material (e.g. shingles, felt, etc.) 195 can be applied to the eave roof sheathing 201. A soffit panel 202 can be nailed from underneath to the eave soffit nailer 200 and the facia nailer 196. It will be understood that a variety of forms of eave structure may be utilized, in conjunction with the building according to the present invention, in order to permit water drain away from the roof and walls of the building, while at the same time providing an attractive eave and weather seal which extends over an eave joint 199 between the vertical truss members 25, 26 and the lower arch truss members 34.

The eave joint 199 is shown in FIG. 7 and is formed by correcting the angle section endpieces 70 of a vertical truss 25 with similar endpieces 70 on the lower end of a lower arch truss member 34. Preferably the corresponding, opposed endpieces 70 include aligned receivers 204 for bolts 205 threadably mounting nuts 206. Floor joists joints 208 are formed at the intersections of the horizontal truss members 40 and the vertical truss members 26, 27 by bolting together angle-section endpieces 70. Between the upper ends of the lower arch members 34 and the lower ends of the upper arch members 35 the knee joints or first roof joints 209 are formed by bolting together angle-section endpieces 70. The upper, inner ends of the upper arch members 35 are joined at ridge or roof peak joints 210 by bolting together endpieces 70 thereat.

In proximity to the joints 199, 208, 209 and 210, panels or sheets of material form various intersections. For example, at the eave joints 199 the roof sheathing material forms an intersection on the outside and on the inside the wall covering material (e.g. paneling, plasterboard, etc.) forms an intersection with the underlayment or subfloor for the second floor 84. Below the floor joist joints 208 the inner side walls 96 intersect the ceiling material for the first floor. At the knee joints 209 the roof sheathing 98 forms an intersection on the outside and the wall/ceiling material forms an intersection on the inside. At the ridge joint 210 the roof sheathing 98 forms an intersection.

Where such intersections are formed between sheets or panels of building material (e.g. plywood, particle board, paneling, plasterboard, hardboard siding, rigid insulation, etc.) it is generally preferable to nail or otherwise fasten the edges of the intersecting sheets or panels to a suitable structural member. Boards which are generally referred to as "nailers" are commonly provided for this purpose in construction.

Figure 8:
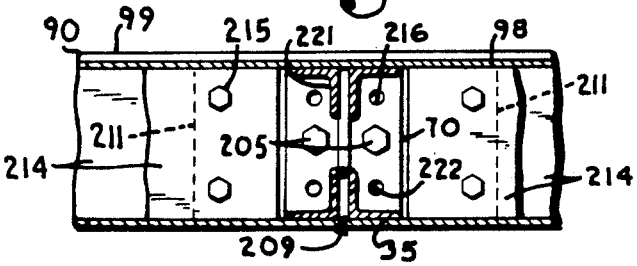
FIG. 8 is an enlarged, fragmentary, cross-sectional view of the structure taken generally along line 8—8 in FIG. 4.

Accordingly, the building structure of the present invention includes such nailers and a system for fastening them to the framing system 2. Referring to FIG. 8, the nailer system includes plates 211 each having a proximate bolt receiver 212, a pair of distal lag screw receivers 213 and a pair of ventilation ports 216. The plates 211 are fastened to the endpieces 70 forming the joints 199, 208, 209 and 210, with the plate bolt receivers 212 receiving the joint bolts 205. The plates 211 project generally laterally from the joints and nailers 214 are attached thereto with lag screws 130 placed in the lag screw receivers 213 and screwed into the ends of the nailers 214. Each nailer fastened in this manner extends generally horizontally between corresponding plates 211 of adjacent arches 10. The nailers 214 may be used singly or in pairs. For example, a pair of nailers 214 are shown in FIG. 8 extending between plates clamped within a knee joint 209. At their ends, the nailers 214 shown in FIG. 8 are secured together by bolts 215 extending through the plate distal receivers 213 and the ends of the nailers 214; the bolts threadably mounting nuts. The edges of the various panels and sheets of building materials in proximity to these joints 199, 208, 209 and 210 may be suitably fastened (e.g. nailed, glued, etc.) to the nailers 214.

A ventilation system 220 is provided for the outer walls 4 and the roof 5 to remove condensation trapped therein. The ventilation system 220 includes truss passages 221 which are generally defined as the open areas in the truss members through which the chords or cross-bracing 54 extends in a zig-zag configuration. The truss member endpieces 70 include ventilation ports 222 which align with each other and with ventilation ports 216 in the plates 211 at the joints 199, 209 and 210 whereby air can pass through the vertical truss members 25, 26; the lower arch truss members 34; and the upper arch truss members 35 in an uninterrupted fashion. The truss passages 221 in the upper arch truss members 35 communicate with a plenum 223 formed under a ridge beam 224 formed by pairs of nailers 214 extending between respective ridge joints 210. The plenum 223 is enclosed on the bottom by a ceiling soffit 225 including appropriate ceiling sheet or panel material (e.g. paneling, plasterboard, etc.) attached from underneath to crossbeams or ridge ceiling joists 227. The plenum 223 communicates to the outside atmosphere through gable vents 228 located in the end walls 110, 111.

In a well-insulated, energy efficient structure, such as that which can be constructed with the building structure and method of the present invention, the well-insulated walls are generally relatively impervious to air. However, the interior portions of such exterior walls tend to change temperature with the temperature changes of the outside, ambient air and with exposure to solar insolation. Such temperature changes within the external walls can cause condensation which can become trapped therein if not provided with proper means for dissipation. In particular, the trapped condensation can damage structural components through rot, rust, corrosion, etc. and can eventually cause the insulation 189 therein to lose its effectiveness as it becomes impregnated with moisture. The ventilation system 220 described above can be helpful for reducing such deleterious effects of trapped condensation by providing an escape route therefor. In operation, temperature changes and temperature differentials may cause air to flow from the insulation 189 to the truss passages 221 for conveyance to the plenum 223 and thence through the gable vents 228 to the atmosphere. The side walls and roof of the building 1 could thus be adapted to "breathe" to release moisture-ladden air. The end walls 110, 111 of the building 1 could be vented in a conventional manner if such where deemed necessary.

Figure 11:
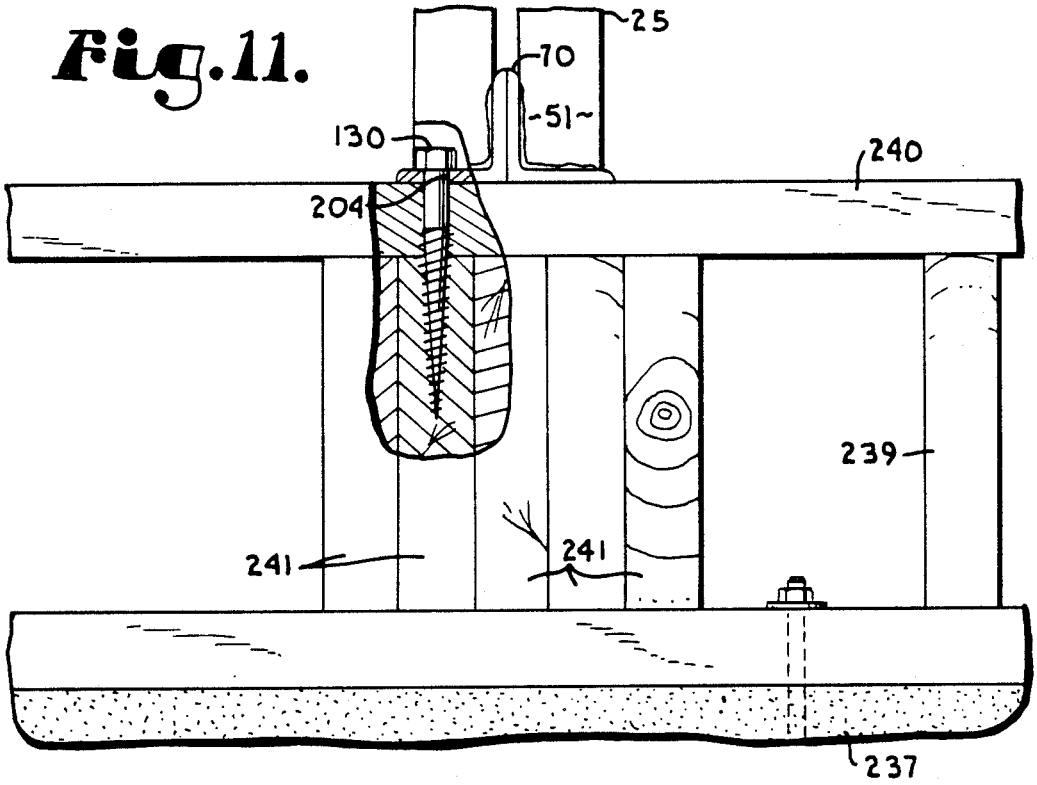
FIG. 11 is an enlarged, fragmentary, vertical cross-sectional view of a building structure comprising a first modified embodiment of the present invention with an alternative foundation and first floor structure.
Figure 9:
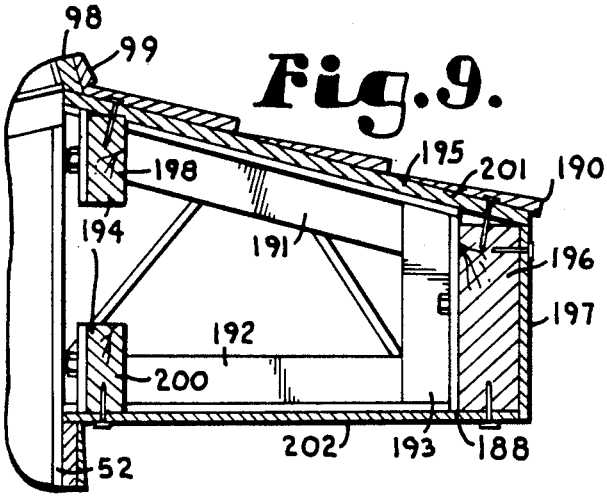
FIG. 9 is an enlarged, fragmentary, vertical cross-sectional view of the building structure, particularly showing an eave assembly thereof.
Figure 10:
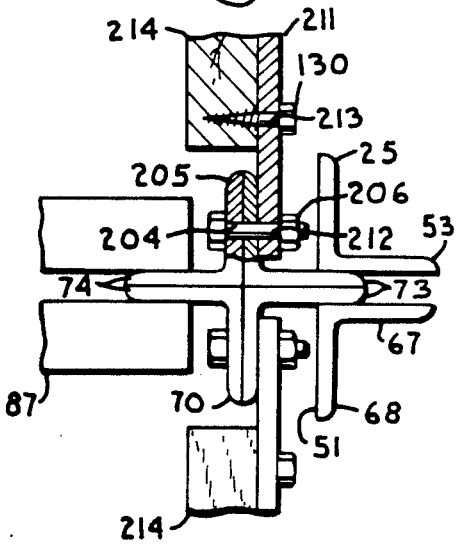
FIG. 10 is an enlarged, fragmentary, top plan view of the building structure, taken generally along line 10—10 in FIG. 7 and particularly showing a floor joist joint.

Referring to FIG. 11, an alternative foundation configuration is shown and includes a foundation wall 237 with a sill plate 238 bolted to the top thereof. A plurality of floor joists 239 are supported on the sill plate 238 and in turn support a subfloor 240. The floor joists 239 may comprise, for example, two-by-ten boards. A plurality of relatively short (e.g. about sixteen inches) blocking boards 241 are fastened (e.g. nailed, glued, etc.) together in juxtaposed relation and placed between the sill plate 238 and the subfloor 240 beneath each vertical truss member 25, 26. The blocking boards 241 may comprise, for example, lumber with the same nominal, cross-sectional dimensions as the floor joists 239, e.g. two-by-tens. The blocking boards 241 function to distribute the weight or load carried by the vertical trusses 25, 26 over a sufficiently large area of the sill plate 238 and the foundation wall 237.

A building method according to the present invention includes the steps of providing a foundation, which may comprise tiers, a slab or foundation walls, and constructing a first floor structure thereon unless the foundation comprises a slab which also serves as the first floor structure. The building method includes appropriate steps to construct the building structure 1 of the present invention described herein.

It is believed that from the previous description, and general knowledge of conventional building techniques, applicant's invention may be fully understood. In view of this, further details concerning its general application are not believed necessary for teaching one skilled in the art to employ this invention.

In sum, the invention may be viewed in a plurality of different ways:

First, referring to FIGS. 1 and 2, the invention may be viewed as comprising a single framing unit having truss members extending along outer edges thereof, with cross-members extending therebetween. The truss members each include a longitudinal channel in which support members are mounted to form cross-member receiving pockets. The cross-member, or cross-members, then extend(s) between pockets on the end truss members to form horizontal support for wall sections, such as wall coverings. Preferably the truss members are I-shaped in cross-section and have constant cross-sectional dimensions, for ease of fitting together of the parts and complete enclosure of the truss members by outer and inner wall coverings. It will be understood that such framing units have a similar description whether used as vertical walls, slanted roof units, horizontal lofts or floor members.

It will similarly be understood by reference to FIGS. 1 and 2 that individual framing units, according to the present invention, may be utilized in conjunction with one another in order to fully support a building structure. In particular, framing units may be positioned side by side through the utilization of a plurality of truss units oriented in lateral spaced relationship with respect to one another, and with cross-members extending therebetween. For the building 1 shown in FIGS. 1 and 2, for example, any one of the lower sidewalls of the building comprises two framing units adjacent to one another, formed from three truss units. A central truss unit, due in part to its I-shaped cross-section, is capable of receiving and supporting cross-members coming from opposite directions. It will be understood that a plurality of such framing units can be aligned laterally with respect to one another. Similarly, by arching a plurality of truss units over the building 1, analogous framing units can be utilized to provide framing for the building roof 5.

Again, ease of constructing a building according to the present invention, and completely enclosing the building structural members between interior and exterior coverings, is readily understood by reference to FIGS. 1 and 2. Multiple arching units 10, comprising truss members according to the present invention, form the major transverse framing. Extending between adjacent arch units are the cross-members 15. The cross-members form ribs extending both along the walls and the roof of the building. To these ribs, both outer- and inner-roofing and wall coverings may be mounted. Horizontal members in the arch units may be utilized to create a second floor or loft 84.

Buildings according to the present invention should be relatively easy and inexpensive to construct. As shown, the vertical truss members can be easily anchored to the foundation 11. The upper arching portion comprises truss members which may be readily welded or bolted to the lower vertical truss members. Since the truss members are relatively narrow in cross-section, and complex bridge-work is not utilized to maintain their structure, they may be shipped relatively easily and assembled relatively easily. The horizontal truss members provide for structural integrity of the arches by preventing spreading of the arches under the weight of the roof of the building.

When a sufficient portion of the arch units are constructed, the walls may be relatively easily erected by placing the cross-members 15 into position. If the cross-members are appropriately selected in size relative to the receiving pockets, there will be a snug engagement between the two, and the boards may be literally pounded into position by means of a hammer, mallet or the like. It will be understood that this can be accomplished relatively easily by one or two workers, and in a relatively fast fashion. Similarly, the floor joists for the loft may be placed in position. Although the cross-members will be easily retained in position by a snug fit in the receiving pockets, if desired anchoring screws, as illustrated and described previously, can be utilized to secure the connection. Again, these may be relatively rapidly placed.

Also, the walls and roof may be rapidly enclosed by mounting covering along the outside and inside portions of the cross-member(s) 15. The truss members may be easily enclosed within, and hidden underneath, the wall covering as they are relatively narrow and are of constant cross-section, and extensive bracing or bridge-work is avoided. Also, electrical lines, plumbing, insulation or the like may be easily enclosed between the outer and inner wall sections.

In a similar manner, a ceiling may be provided on a lower surface of the loft, and a floor may be provided on an upper surface. Conventional stairs or a ladder might be utilized for access to the loft from the main floor.

The building 1 may be completely enclosed by end-walls 110 and 111 constructed as described above, by generally conventional means, through the utilization of header boards and base boards attached to horizontal beam members in the end arch units. As indicated in FIG. 1, windows and doors may be provided in the walls as desired.

From the above, numerous advantages to the present invention will be understood. For example, the buildings are relatively easy to construct, do not involve large prefabricated components, and, especially once the arch units are in place, a large, highly skilled, work force is generally not necessary. Also during construction relatively little temporary bracing is needed, facilitating construction and making the building less susceptible to weather damage.

Further, the buildings include no load-bearing internal walls, that is no internal walls which support the weight of the roof and wall structure. Thus, large, open, floor plans are allowable and if internal walls are desired, they may be easily provided by means of a relatively light framework.

Also, the sidewalls of the building include, between the truss members, large expanses of non-load-bearing wall. That is, the relatively narrow truss members generally take up the weight of the roof and wall structure, rather than the central portions of the walls themselves. This enables the introduction of various windows 231 and doors 232 in respective openings 233 and 234 almost wherever desired, between the arch units, without significantly weakening the building structure.

It is also shown that such building framing units may be utilized to create relatively comfortable residential buildings, since the truss members, being relatively narrow, can be easily and substantially completely enclosed within inner and outer walls, along with insulation.

Large metal bridge-work or bracing-work extending vertically between portions of the truss members is generally avoided by using the present invention. Thus, not only are the walls easy to cover and insulate, the building is generally more attractive in appearance, as might be desired for a residential building versus an out-building for a shop or the like.

Even if some of the cross members are interrupted by doors, windows, skylights or the like, lateral rigidity of the arch members with respect to one another will be maintained by those cross-members which are left uninterrupted.

It is to be understood that while certain embodiments of the present invention have been illustrated and described, it is not to be limited to the specific forms or arrangement of parts herein described and shown, except as limited as by the claims.

What is claimed and desired to be secured by Letters Patent is as follows:

1. A building structure, which comprises:

(a) a foundation;

(b) a first floor associated with and supported by said foundation;

(c) a multiplicity of arch units each including:

(1) a pair of vertical truss members each having a lower end mounted on said first floor and an upper end;

(2) a horizontal truss member having opposite ends each connected to a respective vertical truss member adjacent to its upper end at a respective floor joist joint;

(3) a pair of lower arch truss members each having a lower, outer end connected to a respective vertical truss member upper end at an eave joint and an upper, inner end, each said lower arch truss member sloping upwardly and inwardly from its lower end to its upper end;

(4) a pair of upper arch truss members each including a lower, outer end connected to a respective lower arch truss member upper end at a knee joint and an upper, inner end, said upper arch truss member ends being connected at a ridge joint;

(5) each said truss member comprising inner and outer pairs of angle sections with respective flanges forming inner and outer truss member faces, said flanges forming side walls defining laterally-open, vertically-extending truss member channels;

(6) each said truss member including a chord member extending in a zig-zag configuration between said inside and outside pairs of angle sections between said channels;

(7) each said truss member including a pair of endpieces each at a respective end thereof, each said endpiece comprising a pair of angle sections connected to and extending between said inner and outer pairs of angle sections, said endpiece angle sections having coplanar flanges, said coplanar flanges of respective endpieces at said joints including aligned bolt receivers and aligned ventilation ports, said ventilation ports communicating air between innerconnected truss members through said connecting joints; and (8) each said truss member including a plurality of angle-section clips each located in said channel and including a flange extending perpendicularly across said channel and including a clip receiver, adjacent pairs of said truss members including horizontally aligned clips;

(d) a plurality of side cross-members extending between adjacent pairs of said vertical truss members;

(e) a plurality of floor joist cross-members extending between adjacent pairs of said horizontal truss members;

(f) a plurality of roof cross-members extending between adjacent pairs of said lower arch truss members;

(g) a plurality of roof cross-members extending between adjacent pairs of said upper roof truss members;

(h) each said cross-member having opposite ends, each said end being compressed across its width and compression-fit within a respective channel against a respective clip;

(i) a plurality of screws each placed in a respective clip receiver and in a respective cross-member end;

(j) each said arch unit including at least one nailer mounting plate at each said joint, each nailer mounting plate including a proximate bolt receiver aligned with respective endpiece receivers and receiving a respective truss member connecting bolt, a ventilation port aligned with said endpiece ventilation ports and a distal receiver positioned in laterally-spaced relation from said joint, said nailer mounting plates being positioned in opposed, horizontally-aligned pairs on adjacent arch units;

(k) a plurality of nailers each having opposite ends connected to respective nailer mounting plates by screws placed in said distal receivers and in said nailer ends; each said nailer extending horizontally between adjacent arch units in proximity to corresponding arch unit joints;

(l) each said clip flange forming a pocket with respective truss member side walls, each said pocket being adapted to receive a respective cross-member end and having a width less than the width of said cross member between a respective adjacent pair of truss members mounting same;

(m) an outer side wall attached to the outside of said side wall cross-members on the outside of said building structure;

(n) an inner side wall attached to the inside of said side wall cross-members on the inside of said building structure and to a respective nailer extending between said floor joists joints;

(o) a second floor including said horizontal truss members, said floor joist cross-members and a subfloor mounted on top of said floor joists and connected to said nailer extending between said floor joist joints;

(p) roof sheathing mounted on said roof cross-members and attached to said nailers extending between said eave joints, said knee joints and said ridge joints;

(q) roofing material mounted on said roof sheathing;

(r) a pair of end walls each including:

(1) a lower end wall comprising a bottom plate attached to said first floor and extending generally between the lower ends of a respective pair of vertical truss members and a top plate attached to the underside of a respective horizontal truss member and a plurality of studs extending vertically between said bottom and top plates; and (2) an upper end wall including a bottom plate attached to said second floor and extending generally between the lower ends of respective lower arch truss members, a pair of lower arch plates each attached to the underside of a respective lower arch truss member, a pair of upper arch plates each attached to the underside of a respective upper arch truss member and a plurality of vertical studs extending between said bottom plate and said arch plates; and (s) a ventilation system comprising:

(1) a plurality of crossbeams extending horizontally between said cross-members connected to said upper arch truss members in spaced relation below said ridge nailer;

(2) a ceiling panel fastened to the undersides of said crossbeams;

(3) a plenum formed between said ridge nailer and said ceiling panel, said plenum communicating with said air passages in said upper arch truss members; and (4) a pair of gable vents each located in a respective end wall and communicating with said plenum.

2. The building structure according to claim 1, which includes:

(a) said foundation comprising a concrete slab including said first floor.

3. The building structure according to claim 1, which includes:

(a) said foundation comprising a foundation wall and a sill plate mounted on top thereof;

(b) said first floor including a plurality of floor joists supported by said sill plate and a subfloor mounted on top of said floor joists; and (c) a plurality of blocking board assemblies each comprising a plurality of boards attached to each other in juxtaposed relation, each said blocking board assembly being positioned between said subfloor and said sill plate beneath a respective vertical truss member.

4. The building structure according to claim 1, which includes an eave assembly comprising:

(a) a plurality of eave truss members each attached to and extending outwardly from a respective vertical truss member in proximity to the upper end thereof, each said eave truss member comprising an upper bar sloping outwardly and downwardly from said vertical truss member upper end, an endpiece located at an outer end of said eave truss member, a lower bar located below said upper bar and extending from said endpiece to said vertical truss member and a pair of nailer clips mounted on said upper and lower bars;

(b) upper and lower nailers extending between the respective upper and lower nailer clips of adjacent eave truss members;

(c) a facia nailer mounted on and extending between adjacent outer endpieces;

(d) eave roof sheathing attached to said upper nailer and said facia nailer;

(e) eave roofing material mounted on said eave roof sheathing in covering relation thereover;

(f) a facia board mounted on said facia nailer on the outside thereof; and (g) a soffit panel mounted on said lower nailer said facia nailer beneath said lower bars.

5. A building method, which comprises the steps of:

(a) constructing a foundation;

(b) constructing a first floor on and supported by said foundation;

(c) providing a plurality of vertical, horizontal, lower arch and upper arch truss members each with a longitudinally-extending, laterally-open channel and a plurality of angle-section clips extending across said channel whereby a plurality of pockets are formed;

(d) erecting a plurality of lower subframe units by mounting horizontal truss members at opposite ends thereof to upper ends of respective pairs of vertical truss members on said first floor and raising said lower subframes to vertical, parallel positions;

(e) interconnecting said lower subframes with a plurality of side wall cross-members each having opposite ends compression fit in respective vertical truss member pockets;

(f) extending a plurality of second floor joist truss members each having opposite ends between respective adjacent pairs of horizontal truss members by compression fitting said floor joist ends in respective horizontal truss member pockets;

(g) erecting upper arch units on top of said lower subframes by attaching lower arch truss members to vertical truss member upper ends and extending said lower arch truss members upwardly and inwardly therefrom and by attaching upper arch truss members to said lower arch truss members by extending said upper arch truss members from upper ends of said lower arch truss members to a ridge line and by innerconnecting said upper arch truss member upper ends at said ridge line;

(h) mounting nailer plates on said truss members at floor joist intersections between respective vertical truss member upper ends and horizontal truss member ends, eave joints between respective vertical truss member upper ends and lower arch truss member lower ends, knee joints between respective lower arch truss member upper ends and upper arch truss member lower ends, and ridge joints between respective pairs of upper arch member upper ends;

(i) extending a plurality of nailers between respective, adjacent, horizontally aligned pairs of nailer plates;

(j) attaching outer side walls to the outsides of said side wall cross-members;

(k) attaching inner side walls to the insides of said side wall cross-members and respective nailers extending between said floor joist joints;

(l) extending a plurality of roof cross-members between respective, adjacent pairs of lower and upper arch truss members by compression fitting opposite ends thereof into respective pockets;

(m) applying roof sheathing to the outside of said roof cross-members and to nailers extending between respective, adjacent, horizontally-aligned pairs of eave joints, knee joints and ridge joints;

(n) applying roofing material to said roof sheathing;

(o) applying a second floor subfloor to said second floor joist cross-members and to respective nailers extending between respective, adjacent, horizontally-aligned pairs of floor joist joints; and (p) applying interior wall/ceiling material to the insides of said roof cross-members and to nailers extending between respective, adjacent, horizontally-aligned pairs of eave joints, knee joints and ridge joints.

* * * * *